US009561528B2

(12) United States Patent
Kazakov et al.

(10) Patent No.: US 9,561,528 B2
(45) Date of Patent: Feb. 7, 2017

(54) METHOD FOR X-RAY LUMINESCENT SEPARATION OF MINERALS AND X-RAY LUMINESCENT SEPARATOR

(71) Applicant: RESEARCH AND PRODUCTION ENTERPRISE "BOUREVESTNIK", St.Petersburg (RU)

(72) Inventors: Leonid Vasilievich Kazakov, Saint-Petersburg (RU); Natalia Pavlovna Kolosova, Saint-Petersburg (RU); Pavel Nikolaevich Kuchin, Saint-Petersburg (RU); Vladimir Iosifovich Tsvetkov, Saint-Petersburg (RU)

(73) Assignee: RESEARCH AND PRODUCTION ENTERPRISE "BOUREVESTINIK" (RU)

( * ) Notice: Subject to any disclaimer, the term of this patent is extended or adjusted under 35 U.S.C. 154(b) by 0 days.

(21) Appl. No.: 14/434,508

(22) PCT Filed: Nov. 21, 2013

(86) PCT No.: PCT/RU2013/001039
§ 371 (c)(1),
(2) Date: Apr. 9, 2015

(87) PCT Pub. No.: WO2014/178753
PCT Pub. Date: Nov. 6, 2014

(65) Prior Publication Data

US 2016/0038979 A1 Feb. 11, 2016

(30) Foreign Application Priority Data

Apr. 29, 2013 (RU) ..... 2013120814

(51) Int. Cl.
*B07C 5/346* (2006.01)

(52) U.S. Cl.
CPC ..... *B07C 5/346* (2013.01)

(58) Field of Classification Search
CPC ..... B07C 5/342; B07C 5/344; B07C 5/346; B07C 5/3416; B03B 13/06
(Continued)

(56) References Cited

U.S. PATENT DOCUMENTS 4,848,590 A * 7/1989 Kelly ..... B07C 5/3427 209/564
7,763,820 B1 * 7/2010 Sommer, Jr. ..... B07C 5/346 209/576
(Continued)

FOREIGN PATENT DOCUMENTS

GB 1379923 A 1/1975
RU 2303495 C2 7/2007
(Continued)

OTHER PUBLICATIONS

Translation of Russian Written Opinion; Russian Written Opinion; and Russian International Search Report for PCT/RU2013/001039. Publication for PCT/RU2013/001039.

*Primary Examiner* — Terrell Matthews
(74) *Attorney, Agent, or Firm* — Garcia Zamor IP Law; Ruy M. Garcia-Zamor

(57) ABSTRACT

The invention relates to the area of mineral processing, and more particularly to separation of crushed mined material containing minerals, which are luminescent under the action of exciting radiation, into products to be concentrated and tailing products. The invention can be implemented both in X-ray-luminescent sorters at all beneficiation stages and in product inspection devices, like diamondiferous raw materials testing. The method of X-ray-luminescent separation of minerals consists of transportation of the flow of material being separated, irradiation of this material by periodic sequence of exciting radiation pulses within the specified
(Continued)

section of the material free falling trajectory, registration of intensity of the mineral luminescence signal during each sequence period, real-time processing, in accordance with the specified conditions for each of the kinetic components of the registered signal, in order to determine the separation parameters, comparison of the parameters obtained to be specified threshold values, and separation of the mineral to be concentrated from the flow of material being transported according to the results of comparison.

8 Claims, 4 Drawing Sheets

(58) Field of Classification Search
USPC ..... 209/576, 587, 588, 589
See application file for complete search history.

(56) References Cited

U.S. PATENT DOCUMENTS 8,766,129 B2 * 7/2014 Kazakov ..... B07C 5/342
209/589
8,878,090 B2 * 11/2014 Vladimirov ..... B07C 5/342
209/589

FOREIGN PATENT DOCUMENTS

RU 2310523 C1 11/2007
RU 2437725 C1 12/2011

* cited by examiner

METHOD FOR X-RAY LUMINESCENT SEPARATION OF MINERALS AND X-RAY LUMINESCENT SEPARATOR

TECHNICAL FIELD

The invention relates to the area of mineral processing, and more particularly to separation of crushed mined material containing minerals, which are luminescent under the action of exciting radiation, into products to be concentrated and tailing products. The invention can be implemented both in X-ray-luminescent sorters at all benefication stages and in product inspection devices, like diamondiferous raw materials testing.

PRIOR ART

There are some prior art methods for separating bulk mixtures of various minerals into concentrated and tailing products based on analysis of the registered signal of their luminescence arising under the action of electromagnetic radiation.

For example, a method is known for sorting out diamonds, both from a mixture of diamonds with other minerals and from a mixture of diamonds by their types, in particular, separation into type I or II based on analysis of spectral characteristics of registered thermoluminescence radiation of minerals [GB 1379923, B07C 5/342, 08.01.1975; GB 1384813, B07C 5/34, 26.02.1975]. In this method, the conveyed mineral mixture is irradiated first by exciting radiation from a source of gamma ($Co^{60}$ isotope), X-ray or ultraviolet radiation, and after termination of the luminescence arising in minerals, at the next transportation section, the mixture is heated, which causes thermoluminescence of minerals that is registered and analysed by means of a grating spectral device. Diamonds are sorted out on the basis of differences in the spectral characteristics registered.

This method features a sufficiently high selectivity of mineral separation.

However, it has a rather low productivity as it requires quite a lot of time (up to several hundreds of milliseconds) for registration and analysis of characteristics. Therefore, its use under conditions of mining processing factories is extremely limited. In addition, in order to implement this method, it is preferable to use a radioactive radiation source ($Co^{60}$ isotope) and a spectrometer with sufficiently high resolution.

A method is also known for X-ray-luminescent separation of minerals based on selection of a spectral range for registration of the integral signal of mineral luminescence, which is to be performed in the region of minimum spectral density of mineral luminescence of the separation tailing product [RU 2334557, C2, B03B 13/06, B07C 5/342, 27.09.2008].

The method has sufficiently high mineral separation selectivity.

However, its sensitivity is not sufficiently high for using in sorters with a high (100 ton/hour) and medium (10 t/h) production capacity, especially for extracting weakly luminescing diamonds, as in such spectral filtration of mineral luminescence the registered intensity of radiation of the mineral (diamond) to be concentrated will decrease by half.

Methods are also known for separating bulk mixtures of various minerals based on the use of differences in the absorption coefficient of X-ray and optical radiations between diamond and an associate mineral in analysis of the registered signal of their luminescence arising under the action of electromagnetic radiation.

For example, a mineral separation method is known consisting of mineral transportation by a monolayer flow, irradiation of minerals by penetrating radiation which excites their luminescence, registration of the luminescence intensity on the side of penetrating radiation and, on the opposite side, determination of the mineral transparency degree and separation of the useful mineral by its degree of transparency for penetrating radiation [RU 2303495, C2, B07C 5/342, 27.07.2007]. The mineral transparency degree for exciting X-ray radiation can be determined by difference of logarithms of luminescence intensities registered on the side of penetrating radiation flux and on the opposite side, or by logarithm of the ratio of these intensities.

With such mineral separation method, it is possible to detect all types of diamonds.

However its selectivity is not sufficiently high as the method's separation parameter does not take into account the optical properties of mineral and depends upon the linear dimensions of mineral (thickness), which varies significantly not only because of a spread within the grain size class of the material being separated but also because of differences in the position of irregularly shaped mineral objects with respect to the direction of effect of the exciting radiation at the moment of registration. In addition, the method does not allow reliable identification of weakly luminescing diamonds, especially among luminescence signals of associate minerals having intensive luminescence, since the use of a logarithmic amplifier in the luminescence signal processing unit with high amplification coefficient for weak signals being close to the natural noise level lead to significant errors.

The actual mineral luminescence signal registered within a certain period of time has kinetic characteristics and can be considered as superposition (overlapping) of two components. In general, such signal can contain a short-lived, or fast, luminescence component ("FC"), which arises virtually simultaneously (at an interval of several microseconds) with the beginning of exposure to the exciting radiation and which is absent immediately after its termination, and a long-lived, or slow, luminescence component ("SC"), intensity of which is continuously growing during exposure to the exciting radiation and decreasing relatively slowly (from several hundreds of microseconds to millisecond unities) after its termination (luminescence afterglow period).

A mineral separation method is known, which comprises mineral transportation in the form of monolayer flow of the material to be separated, irradiation of this material by penetrating radiation, registration, at an obtuse or straight angle with respect to the incident flux of penetrating radiation, of intensity of the short-lived and long-lived mineral luminescence components in overlapping irradiation areas and registration of intensity of the long-lived luminescence component only as well as registration of intensity of air luminescence, the latter being registered beyond the width of flow of the material to be separated, and separation of the useful mineral according to the result of comparison with the specified threshold value for the mineral luminescence intensity registered, which threshold value is proportional to the intensity of air luminescence signal [RU 2310523, C2, B07C 5/342, 20.11.2007].

The method makes it possible to enhance the separation selectivity due to the possibility of using, as mineral separation parameters, not only the difference in absorption of X-ray and optical radiations between diamond and associate mineral but also kinetic characteristics of the mineral luminescence signal that are registered both in the presence and the absence of exciting radiation.

However, due to insufficient sensitivity, the method does not provide reliable identification of the signal of weakly luminescing diamonds, especially among luminescence signals of a number of associate minerals having intensive luminescence.

The closest analogue of the invented X-ray-luminescent mineral separation method is the method including transportation of the flow of material to be separated, irradiation of this material by a sequence of exciting X-ray radiation pulses within a specified section of the material motion trajectory, registration of intensity of the mineral luminescence signal during each sequence period within the material motion trajectory section being irradiated, real-time processing in accordance with the specified conditions for each of the kinetic components of the registered signal for determination of separation parameters, comparison of the parameters obtained to the specified threshold values, and separation of the mineral to be concentrated from the transported material flow according to the results of comparison [RU 2437725, C1, B07C 5/00, 27.12.2011, U.S. Pat. No. 8,878,090 B2, B07C 5/346, B07C 5/342, B07C 5/34, May 23, 2013]. In processing of the signal registered, at first the luminescence signal intensity value in a specified period of time after termination of the exciting pulse is determined, the value obtained is compared to the threshold value specified for it, and, in case the threshold value being exceeded, the signal processing is performed in order to determine the value of separation criterion selected, the result of processing is compared to the specified threshold value of the separation criterion and the mineral to be concentrated is extracted from the material being separated if the result of comparison meets the specified criterion; in case the luminescence signal intensity value obtained is less than its threshold value in a specified period time after termination of the exciting pulse, the luminescence signal intensity value arising during the exciting radiation pulse is determined, then it is to be compared to the threshold value specified for it, and the mineral to be concentrated is extracted from the material being separated in case of the threshold value being exceeded.

Such mineral separation method provides extraction of all types of luminescent minerals to be concentrated from the flow of material being separated with a sufficiently high selectivity, because it uses, as separation criteria parameters, various relations between kinetic characteristics of luminescence signal registered both during exposure of the mineral material to the exciting radiation and after it (during the afterglow period).

However, recovery of weakly luminescent materials, for which the intensity of luminescence of the slow component is below the threshold value, for example, for so called type II diamonds, has the insufficiently high selectivity. This is due to insufficient sensitivity of registration of the fast component of the mineral luminescence signal because of high intensity fluctuations (from 1.5 V to 10 V) of the light signal produced by luminescence of air, various vapors, particles of rock and associate minerals, which are register together with luminescence signal of useful mineral during irradiation.

X-ray-luminescent sorters are also known, in which one or another method from above-described mineral separation methods can be implemented.

For example, an X-ray-luminescent sorter is known that includes a means for transportation of the material being separated, a photo receiving device installed with respect to the motion trajectory of the material being separated on the opposite side of the penetrating radiation source, a mineral luminescence signal processing unit, an air luminescence signal amplitude registration and storage unit and an actuator [RU 2310523, C2, B07C 5/342, 20.11.2007]. The penetrating radiation source is installed so that the width of the irradiation region should exceed the width of flow of the material being separated. The photo receiving device is connected to the first input of the mineral luminescence signal processing unit and to the input of the air luminescence signal processing and storage unit, the output of which is connected to the second input of the mineral luminescence signal processing unit. The output of mineral luminescence signal processing unit is connected to the actuator.

The sorter allows enhancement of the separation selectivity, as the location of the photo receiving device on the opposite side of the penetrating radiation source (at an obtuse or straight angle with respect to the incident flux of penetrating radiation) makes it possible to use differences in the absorption of X-ray and optical radiations between diamond and associate mineral in order to reduce the contribution of luminescence of associate minerals to the luminescence intensity being registered.

However, such sorter has insufficient sensitivity for reliable identification of the signal of weakly luminescing diamonds, especially among luminescence signals of a number of associate minerals having intensive luminescence. This is caused by the fact that the air luminescence signal to be registered by the photo receiving device has a sufficiently high intensity due to increased luminescing volume, which leads to an increase in the separation threshold value, as an identification criterion.

An X-ray-luminescent sorter is known that comprises a means for transportation of the material being separated, an X-ray radiation source, two photo receiving devices, one of which is located on the same side as the X-ray radiation source with respect to the irradiated surface of the material being carried, and the other one is located on the opposite side with respect to the motion trajectory of the material being separated, a digital luminescence signal processing unit, an actuator and receiving bins for tailings and concentrated products [RU 2303495, C2, B07C 5/342, 27.07.2007]. The digital luminescence signal processing unit is provided with functions for logarithmic amplification of the signals from two photo receiving devices, their differential (difference) amplification to be determined as the separation criterion, comparison of the obtained criterion value to the specified threshold value, and generation of a command to be issued to the actuator.

In such sorter, all types of diamonds can be detected.

However, its selectivity is not sufficiently high, as the separation criterion being determined depends upon the mineral dimension (thickness), which varies significantly not only because of a spread within the grain size class of the material being separated but also because of differences in the position of irregularly shaped mineral with respect to the direction of the primary X-ray radiation at the moment of registration. In addition, such sorter does not provide reliable identification of the signal of weakly luminescence diamonds, especially among luminescence signals of a number of associate minerals having intensive luminescence, because the very high amplification coefficient of logarithmic amplifier of the signal processing unit for weak luminescence signals near to the natural noise level leads to significant errors.

An X-ray-luminescent sorter is known, which we have taken as a prototype, that contains a means for transportation of the material being separated, a pulsed exciting X-ray radiation source located above the surface of the material being separated, with the possibility of its irradiation at the section of material free falling trajectory near the place of its descent from the means of transportation, a photo receiving device for luminescence registration located on the same side as the pulsed exciting X-ray radiation source in respect to the irradiated surface of the material being carried, with the possibility of combination of the area of registration of luminescence of the material being carried at the section of its free falling trajectory coinciding with the irradiation area, an electronic unit for setting the threshold values of the luminescence signal intensity and threshold values of separation parameters (criteria), a synchronization unit, a digital luminescence signal processing unit provided with functions for determination of separation parameters, comparison of the parameter values obtained to the corresponding specified threshold values and generation of a command to be issued to the actuator, an actuator and receiving bins for concentrated and tailing products [RU 2437725, C2, B07C 5/00, 27.12.2011, U.S. Pat. No. 8,878,090 B2, B07C 5/346, B07C 5/342, B07C 5/34, May 23, 2013]. The photo receiving device is capable of simultaneous amplification of the signal being registered with various amplification coefficients. As a separation parameters (useful mineral identification criteria), the digital luminescence signal processing unit is capable to determine the values of such luminescence signal characteristics as normalized autocorrelation function, ratio of the fast and slow signal components to the intensity of its slow component, and the luminescence decay time constant after termination of the exciting pulse as well as the value of intensity of the fast luminescence signal component.

Such sorter provides extraction of all types of minerals to be concentrated from the flow of material being separated with a sufficiently high selectivity, as it uses, as separation parameters, various ratios of the kinetic characteristics of the luminescence signal registered both during the mineral material exposure to the exciting radiation and after it (during the afterglow period).

However, in case of extraction minerals with low level of luminescence, for which the intensity of luminescence of the slow component is less than the threshold value, for example, with type II diamonds, the selectivity is insufficiently high. This is caused by the fact that the photo receiving device registers the signal of total intensity of luminescence arising during the effect of X-ray pulse irradiation. This signal includes both the intensity of the fast component of mineral luminescence and the intensity of air luminescence, various vapors, particles of rock and associate minerals. The intensity of this light signal has a high fluctuation (from 1.5 V to 10 V), which determines a relatively high threshold value of intensity of the luminescence signal fast component.

Disclosure of Invention

A very important aim of this invention is the better selective extraction of minerals to be concentrated from the material being separated due to enhancement of the sensitivity of registration in respect of the fast component of mineral luminescence. It is another object of the present invention to provide separation of minerals being concentrated by types simultaneously with the extraction. For example, this concept allows sorting of diamonds into diamonds of type I and diamonds of type II at any beneficiation stages, in particular, at the stage of primary concentration, with a high production capacity of the sorter (up to 100 t/h).

In the present invention there is provided a method of X-ray-luminescent separation of minerals including following steps:

a) Transportation of flow of the material to be separated;

b) Irradiation of this material by a sequence of pulses of the exciting X-ray radiation within the specified section of the free falling trajectory of the material and additional irradiation by exciting X-rays in the section of its transportation up to the boundary with the section of the mineral luminescence signal intensity registration;

c) Registration of the mineral luminescence signal intensity during each sequence period within the irradiated section of the material motion trajectory simultaneously on the irradiated side and on the opposite side of the material flow during each sequence period, while mineral luminescence on the opposite side of the material flow being registered in the spectral range of the maximum luminescence intensity of the material being concentrated only within the irradiated section of the material free falling trajectory;

d) The registered luminescence signals are real-time processed in order to determine the separation parameters in the case where the value of intensity of the slow component of luminescence signal registered on the irradiated side of the material flow exceeds the threshold value specified for it;

e) Calculation of the separation parameters, wherein the value of ratio of the slow component of the luminescence signal registered on the irradiated side of the material flow to the value of the slow component of the luminescence signal registered on the opposite side of the flow is additionally determined as the separation parameter;

f) Comparison of the obtained parameters with their specified threshold values;

g) The useful mineral is ejected from the material being separated if the result of comparison meets the specified criteria;

h) If, on the step d, the slow component of luminescence signal registered on the irradiated side of the material flow do not exceeds the specified threshold value, then the value of intensity of the fast component of the luminescence signal registered on the side opposite to the material flow side is compared with the threshold value specified for it;

i) If the value of intensity of the fast component of the luminescence signal registered on the side opposite to the material flow exceeds the threshold value specified for it, then the value of ratio of the fast component of the luminescence signal registered on the irradiated side of the material flow to the value of fast component of the luminescence signal registered on the flow side opposite to irradiation is determined as the separation parameter;

j) If this latest separation parameter exceeds the specified threshold value, the useful mineral is ejected from the material being separated.

As distinct from the prior art method, in the proposed method for X-ray-luminescent separation of minerals, the material being transported is additionally irradiated by exciting X-ray radiation at the section of its transportation up to the boundary with the section of the mineral luminescence signal intensity registration, the values of mineral luminescence signal intensity are registered simultaneously on the irradiated side and on the opposite side of the material flow during each sequence period, the mineral luminescence signals on the opposite side of the material flow being registered in the spectral range of the maximum luminescence intensity of the material being concentrated only within the irradiated section of the material free falling trajectory, the luminescence signals registered are processed in order to determine the separation parameters in the case where the value of intensity of the slow component of luminescence signal registered on the irradiated side of the material flow exceeds the threshold value specified for it, the value of ratio of the slow component of the luminescence signal registered on the irradiated side of the material flow to the value of the slow component of the luminescence signal registered on the opposite side of the flow is additionally determined as the separation parameter, the result of processing of each luminescence signal is compared to the specified threshold values of the separation parameters and the mineral to be concentrated is isolated from the material being separated if the result of comparison meets the specified criterion; otherwise, the registered luminescence signals are processed if the value of intensity of the fast component of the luminescence signal registered on the side opposite to the material flow side exceeds the threshold value specified for it, and the value of ratio of the fast component of the luminescence signal registered on the irradiated side of the material flow to the value of fast component of the luminescence signal registered on the flow side opposite to irradiation is determined as the separation parameter, the result of processing is compared to the specified threshold value of the separation parameter, and the mineral to be concentrated is isolated from the material being separated if the result of comparison meets the specified criterion.

In processing the mineral luminescence signals where the value of intensity of the slow component of the signal registered on the irradiated side of the material flow exceeds the threshold value specified for it, as separation parameters it is also possible to determine such luminescence signal characteristics as normalized autocorrelation function, ratio of the total intensity of the fast and slow components of the signal to the intensity of its slow component and the luminescence decay time constant after termination of the exciting pulse.

The achievement of the technical result is also provided by the proposed X-ray-luminescent sorter that includes a means for transportation of the material being separated, a source of pulsed exciting X-ray radiation located above the surface of material being transported and capable of its irradiation in the section of the material free falling trajectory near the place of material descent from the means of transportation, a photo receiving device for luminescence registration located on the same side as the pulsed exciting X-ray radiation source in respect to the irradiated surface of the material being transported, so as to combine the area of registration of luminescence of the material being transported in the section of its free falling trajectory with the irradiation area, a means for setting the threshold values of the luminescence signal intensity and threshold values of separation parameters, a synchronization unit, a digital luminescence signal processing unit provided by functions for determination of separation parameters, comparison of the parameter values obtained to the corresponding specified threshold values and generation of a command to be issued to the actuator, an actuator and receivers for the concentrated and tailing products, the sorter additionally including a source of exciting X-ray radiation located above the surface of material being transported so as to ensure its irradiation in the section before the material descent from the means of transportation, and a photo receiving device provided with a means for filtration of the spectral range of the maximum intensity of luminescence of the mineral to be concentrated and located on the side opposite to the exciting X-ray radiation sources in respect of the trajectory of motion of the material being separated, with the possibility of restriction of its field of vision to the irradiated section of the material free falling trajectory so that the distance from the centre of the receiving window of the photo receiving device to the middle of the irradiated section of the material free falling trajectory should meet the following relation:

$$h=L/2*\mathrm{tg}\ \beta/2,$$

where

L is the largest linear dimension of the irradiated section of the material free falling trajectory;

β is the aperture of the photo receiving device;

and the digital luminescence signal processing unit is capable of simultaneous real-time processing of luminescence signals from at least two photo receiving devices and is additionally provided with functions for determination, as the separation parameters, of the value of ratio of the slow component of the luminescence signal registered on the irradiated side of the material flow to the value of the slow component of the luminescence signal registered on the flow side opposite to irradiation, and the value of ratio of the fast component of the luminescence signal registered on the irradiated side of material flow to the value of the fast component of the luminescence signal registered on the flow side opposite to irradiation.

As distinct from the prior art sorter, the sorter additionally includes a source of exciting X-ray radiation located above the surface of material being transported so as to ensure its irradiation in the section before the material descent from the means of transportation, and a photo receiving device provided with a means for filtration of the spectral range of the maximum intensity of luminescence of the mineral to be concentrated and located on the side opposite to the exciting X-ray radiation sources in respect of the trajectory of motion of the material being separated, with the possibility of restriction of its field of vision to the irradiated section of the material free falling trajectory so that the distance from the centre of the receiving window of the photo receiving device to the middle of the irradiated section of the material free falling trajectory should meet the following relation: $h=L/2*\mathrm{tg}\ \beta/2$ where L is the largest linear dimension of the irradiated section of the material free falling trajectory;

β is the aperture of the photo receiving device;

and the digital luminescence signal processing unit is capable of simultaneous real-time processing of luminescence signals from two photo receiving devices and is additionally provided with functions for determination, as the separation parameters, of the value of ratio of the slow component of the luminescence signal registered on the irradiated side of the material flow to the value of the slow component of the luminescence signal registered on the flow side opposite to irradiation, and the value of ratio of the fast component of the luminescence signal registered on the irradiated side of material flow to the value of the fast component of the luminescence signal registered on the flow side opposite to irradiation.

The additional source of exciting X-ray radiation can be made in the form of a pulse X-ray radiation generator or in the form of a constant X-ray radiation generator.

The means of filtration of the spectral range of photo receiving device can be made in the form of a differential optical filter.

The field of vision of the photo receiving device located on the side opposite to the exciting X-ray radiation sources in respect to the motion trajectory of the material being separated can be restricted to the material free falling section coinciding with the section of its irradiation, by means of structural elements of the sorter linked with the photo receiving device by mutual arrangement.

The field of vision of the photo receiving device in the direction of material flow motion can be limited on one side by the edge of the means of transportation of the material being separated, and on the other side by a screen being non-transparent for optical radiation and installed on the side opposite to the exciting X-ray radiation sources transversely to the material free falling trajectory.

The combination of distinguishing and restrictive features being proposed in the inventions meets the "novelty" criterion as it has not been described in the literature known to the inventors.

The combination of distinguishing features and their interrelationship with the restrictive features in the inventions proposed makes it possible to resolve a technical contradiction, i.e. increase in the intensity of the luminescence signal being registered ensures better sensitivity, thereby improving selectivity of extraction; however, this increases the intensity of the light signal from all minerals and air registered during exposure to an X-ray radiation pulse, which leads to a decrease in the sensitivity with respect to the fast component of the luminescence signal and a decrease in the selectivity of extraction of the material being concentrated. The combination of operations proposed in the invention allows enhancement of sensitivity of registration during the effect of X-ray radiation pulse (with respect to the fast component of the luminescence signal) as an increase in the signal/noise ratio due to reduction of fluctuation and a decrease in the level of intensity of the light signal generated by air, various vapours and rock particles and registered during irradiation. The combination and sequence of operations proposed allow taking account of various manifestations of natural peculiarities related not only to the mineral being concentrated but also to the whole material being separated, such as the structure and elemental composition, during interaction with radiation. Identification and accounting of such peculiarities are decisive for the mineral separation criterion being proposed in the invention. The X-ray-luminescent sorter being proposed for implementation of the method fully ensures achievement of the technical result. Hence the technical solutions proposed meet the "inventive step" criterion.

INDUSTRIAL APPLICABILITY

Figure 1A:
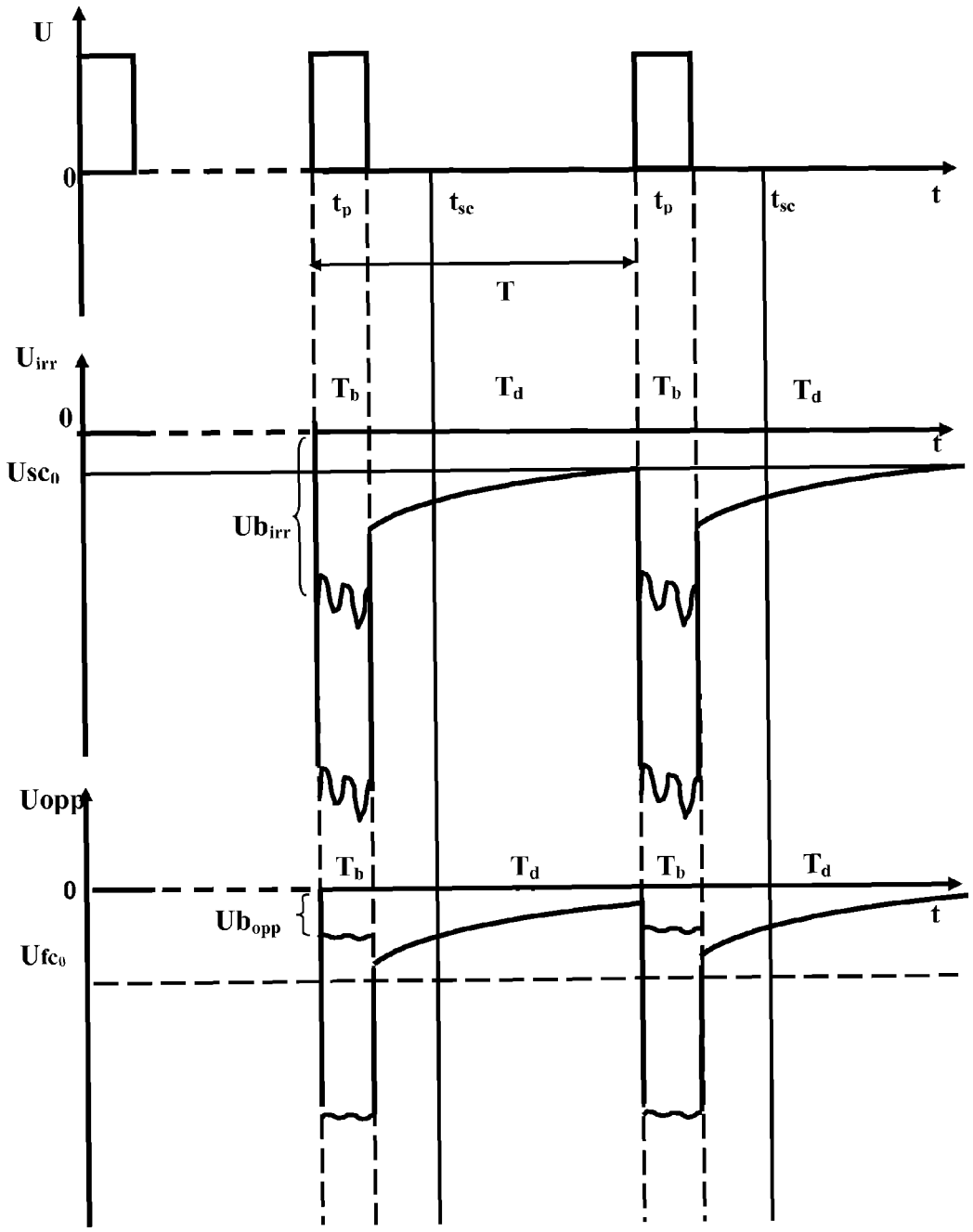
FIG. 1*a* shows the timing diagrams of registered mineral luminescence signals where the slow component is intensive.

The implementation of the proposed method for X-ray-luminescent separation of minerals is performed as follows. The material being separated is transported on a substrate ensuring its movement in the form of a monolayer flow. This material flow is irradiated by exciting X-ray radiation ensuring sufficient occupancy of the long-lived (metastable) states of atoms of the mineral being concentrated during the period of material transportation over the irradiated section of the substrate. As a result, the luminescence of air and minerals from permitted atomic transitions occurs. When the material flow descends from the transporting substrate, it is irradiated by a sequence of pulses $t_p$ of exciting X-ray radiation within the specified section of the material free falling trajectory. The length of this section is selected with consideration for the material transportation velocity, repetition frequency, duration and strength of X-ray radiation pulses, and the section width is limited by the width of incident flow of the material being separated. As a result of mineral exposure to pulses $t_p$ of X-ray radiation (FIG. 1*a, b*), the luminescence arises, intensity of which is apparently caused not only by the direct inverse occupancy of the corresponding levels of permitted transitions in mineral atoms but also by additional occupancy, which is provided, under stimulating action of pulses $t_p$ of radiation, by radiation-free transitions from metastable atom states occupied earlier to permitted states. During the period of the material passing the irradiated section of trajectory, the slow component (SC) of the signal U(t) of the mineral luminescence manages to blaze up. The intensities of signal U=f(t) of the mineral luminescence are registered simultaneously on the irradiated side $U_{irr}(t)$ (FIG. 1*a, b*) and on the opposite side $U_{opp}(t)$ (FIG. 1*a, b*) of the material flow during each pulse sequence period T (FIG. 1*a, b*). In doing so, the intensity of signal $U_{opp}(t)$ is registered in the wave band where the most intensive spectral lines of the mineral being concentrated are located, and the region of glow being observed during registration is limited by the dimensions of section of the material free falling trajectory. The luminescence signals $U_{irr}(t)$ and $U_{opp}(t)$ being registered (FIG. 1*a, b*) can include both the section $T_b$ of buildup of the fast (FC) and slow (SC) components of the luminescence signal and the section $T_d$ of decay of its slow (SC) component (FIG. 1*a,b*). The signals $U_{irr}(t)$ and $U_{opp}(t)$ being registered can contain the section $T_b$ of buildup of FC and, possible, of SC of the luminescence signal and cannot virtually contain the section $T_d$ of decay of its SC (FIG. 1*a, b*). All signals $U_{irr}(t)$ and $U_{opp}(t)$ being registered will be processed in real time in order to determine the value of each of the specified separation parameters. If signals $U_{irr}(t)$ and $U_{opp}(t)$ have the luminescence SC (FIG. 1*a*), then the value of intensity of signal $Usc_{irr}(t_{sc})$ registered at the specified moment of time $t_{sc}$ after termination of pulse $t_p$ of exciting radiation is compared with the threshold value $Usc_0$ specified for it. In case (FIG. 1*a*) of exceeding this value ($Usc_{irr}(t_{sc})>Usc_0$), the signals $U_{irr}(t)$ and $U_{opp}(t)$ are subjected to further processing in order to obtain, as the separation parameter, the values of ratio of the value of SC of the luminescence signal $Usc_{irr}(t_{sc})$ registered on the irradiated side of the material flow to the value of the SC of the luminescence signal $Usc_{opp}(t_{sc})$ registered on the material flow side being opposite to irradiation ($Usc_{irr}(t_{sc})/Usc_{opp}(t_{sc})$) as well as the values of kinetic characteristics of the signal $U_{irr}(t)$ specified as separation parameters for the given case, for example:

normalized autocorrelation function (NCF), which is determined as follows:

$$NCF = \int_0^T F(t) * F(t - Tc) * dt \Big/ \int_0^T F(t) * F(t) * dt,$$

where $T_c$ is the convolution parameter;

ratios of the total intensity of the fast and slow components of the luminescence signal $Usc_{irr}(t_p)$ during the period of effect of the pulse $t_p$ of exciting radiation to the intensity $Usc_{irr}(t_{sc})$ of its slow component at the specified moment of time $t_{sc}$ ($Usc_{irr}(t_p)/Usc_{irr}(t_{sc})$);

luminescence decay time constant after termination of the exciting pulse ($\tau$), which can be determined mathematically from the following expression $$F(t)=F_0\exp(-t/\tau),$$

where $F_0$ is the initial value of the exponent in the luminescence decay region (at $t>t_p$).

Figure 1B:
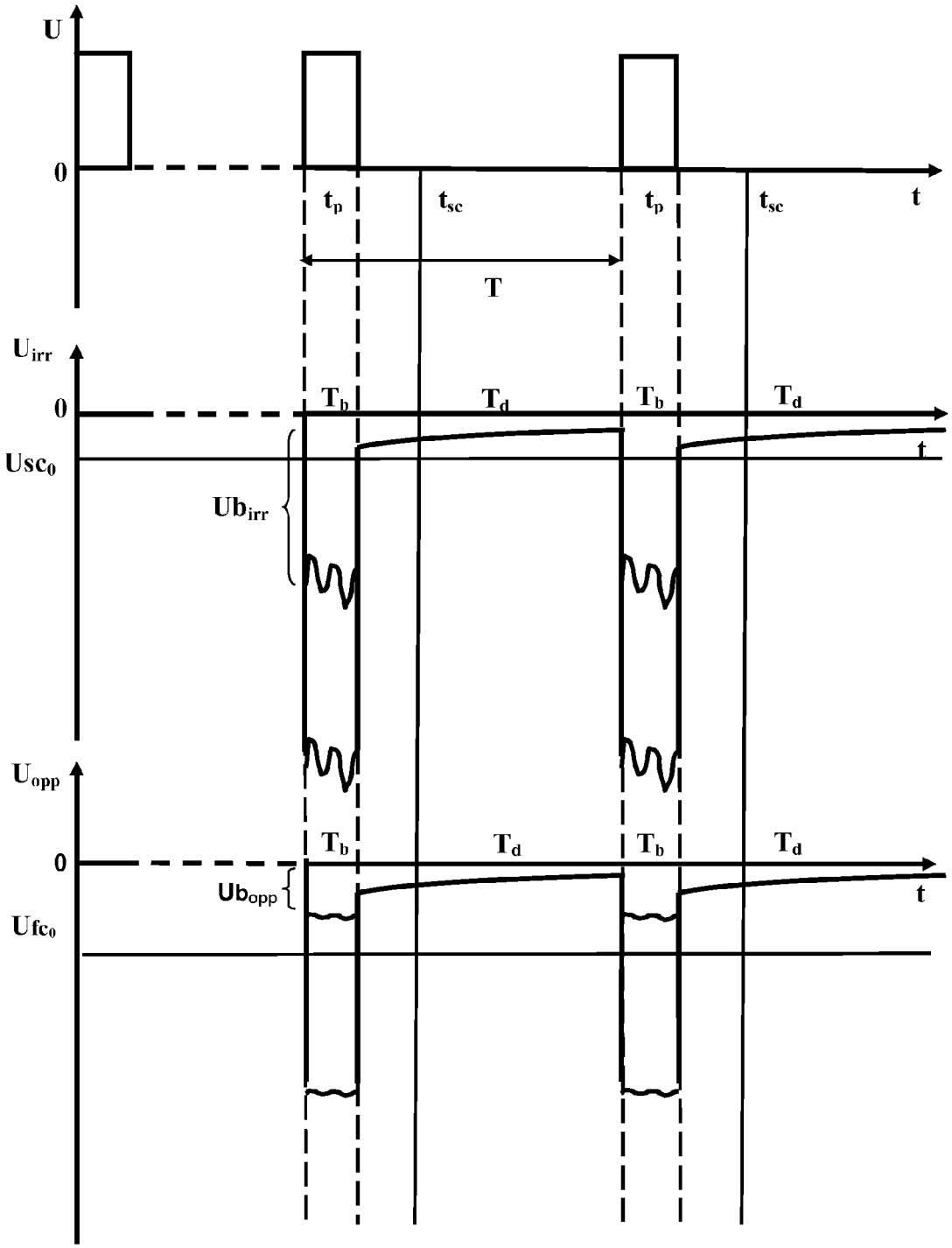
FIG. 1*b* shows timing diagrams of registered mineral luminescence signals where the slow component intensity is insignificant.

The values of separation criterion parameters obtained are compared to the specified threshold values of these parameters, and the mineral to be concentrated is extracted from the material being separated if the separation criterion conditions are met. In such case, a high selectivity of extraction of the mineral to be concentrated is achieved, as the increased intensity of the registered mineral luminescence signals $U_{irr}(t)$ and $U_{opp}(t)$, in particular, weakly luminescing ones, allows identification of their kinetic characteristics and, in particular, detection of the presence of SC ($Usc_{irr}(t_{sc})$ and $Usc_{opp}(t_{sc})$) and performance of their analysis (processing) for conformity to the mineral being concentrated with respect to the separation criterion parameters selected, which take into account, on aggregate, the kinetic and spectral characteristics of the signals $U_{irr}(t)$ and $U_{opp}(t)$ of luminescing minerals and transparency of the luminescing mineral for X-ray and optical radiations. Sensitivity of separation (threshold value $Usc_0$) is determined by the minimum value of the signal $Usc_{irr}(t_{sc})$ at the specified moment of time $t_{sc}$ being typical for the mineral being concentrated. If the value of signal $Usc_{irr}(t_{sc})$ obtained does not exceed the value of $Usc_0$ ($Usc_{irr}(t_{sc})\leq Usc_0$) (FIG. 1*b*), then the intensity of the luminescence signal FC $Ufc_{opp}(t_p)$ is determined, which arises at the time $t_p$ of the effect of action of the exciting radiation pulse and registered on the side being opposite to the material flow irradiation side. The value $Ufc_{opp}(t_p)$ obtained is compared to the threshold value $Ufc_0$ specified for it (FIG. 1*b*). In case this value is exceeded ($Ufc_{opp}(t_p)>Ufc_0$), the value of ratio of the luminescence signal FC value of $Ufc_{irr}(t_p)$ registered on the material flow irradiated side to the luminescence signal FC value $Ufc_{opp}(t_p)$ registered on the side opposite to the material flow irradiation is determined as the separation parameter. The value $Ufc_{irr}(t_p)/Ufc_{opp}(t_p)$ of the separation parameter obtained is compared to the threshold value specified for it and the mineral to be concentrated is extracted from the material being separated with the separation criterion conditions being met. In this case, the selectivity of extraction of the mineral to be concentrated also improved due to enhancement of the registration sensitivity. Sensitivity of separation (threshold value of $Ufc_0$) is determined by the minimum value of the signal $Ufc_{opp}(t_p)$ during the time $t_p$ of the effect of X-ray radiation pulse, which is ensured by a decrease in the fluctuation and a lower level of intensity of the light signal generated by air, various vapours and rock particles also being registered during the irradiation time $t_p$, due to shielding of this light signal by particles of materials and associate minerals being non-luminescent and non-transparent in the X-ray and optical ranges and being located in the restricted registration region as well as due to spectral selectivity of the signal $Ufc_{opp}(t_p)$ being registered, which allows an increase in the sensitivity of its registration by 3÷10 times. So the method proposed takes into account various manifestations of natural peculiarities of not only the material to be concentrated but also of the whole material being separated, such as the structure and the elemental composition, during its interaction with radiation.

Preferred Embodiment of the Invention

The detailed implementation of the above-mentioned method is explained by the example of operation of the X-ray-luminescent sorter proposed in the invention.

The sorter (FIG. 2) by means of which the proposed method is implemented includes means 1 for transportation of the material 2 being separated, sources 3 and 4 of exciting X-ray radiation, devices 5 and 6 for photo receiving the mineral luminescence, unit 7 for digital processing of luminescence signals $U_{irr}(t)$ and $U_{opp}(t)$, means 8 for setting the threshold values of $Usc_0$ and $Ufc_0$ of the intensity of luminescence signals $Usc_{irr}(t_{sc})$ and $Ufc_{opp}(t_p)$, respectively, and threshold values of the separation parameters specified, synchronisation unit 9, actuator 10, receiving bins 11 and 12, respectively, for the mineral to be concentrated and the tailing product.

Transportation means 1 is made in the form of a sloping chute and is designed for transportation, at the required velocity (for example, at the velocity within the range from 1 to 3 m/s), of the flow of material 2 being separated through the areas of irradiation, registration and separation (cut-off). Sources 3 and 4 are made in the form of X-ray radiation generators and are designed for irradiation of the flow of material 2 being separated. Photo receiving devices (PRD) 5 and 6 are designed for converting the mineral luminescence into electrical signals $U_{irr}(t)$ and $U_{opp}(t)$, respectively. Unit 7 for digital processing of signal U(t) is designed for processing signals $U_{irr}(t)$ and $U_{opp}(t)$ from PRD 5 and 6, respectively, for determining the values of separation parameters specified, for comparing the parameter values obtained to the corresponding specified threshold values and for generating a command to actuator 10 to separate the mineral being concentrated according to the result of comparison. Unit 9 is designed for synchronization of the required operating sequence of assemblies and units included in the sorter. Source 3 is located above chute 1 and is designed for irradiation of the flow of material 2 being on chute 1. Source 3 can be made in the form of an X-ray radiation generator or in the form of a constant X-ray radiation generator. Source 4 is made in the form of a generator producing continuous sequence of X-ray pulses and located above the flow of material 2 being separated; it is designed for irradiation of flow 2 in the section of free falling trajectory of material 2 near the place of its descent from chute 1. PRD 5 and PRD 6 are installed on different sides with respect to the surface of flow 2 being irradiated by source 4. PRD 5 is installed above the surface of flow 2 being irradiated by source 4 for registration of luminescence from the section of its free falling trajectory, which coincides with the irradiation region (excitation/registration area). PRD 6 is installed on the opposite side of the irradiated surface of flow 2 with the possibility of restriction of its field of vision to the section of free falling trajectory of material 2, which is irradiated by source 4 (excitation/registration area). Distance h from the centre of receiving window of PRD 6 to the middle of the section of free falling trajectory of material 2, which is irradiated by source 4, can be determined by the following relation:

$$h=L/2*tg\beta/2 \text{ where}$$

L is the largest linear dimension of the irradiated section of the material free falling trajectory;

β is the aperture of the photo receiving device.

The field of vision of PRD 6 (FIG. 2, 2*a*) is limited in the direction of motion of flow 2 by the edge of chute 1, on the one side, and, on the other side, by shield 13 made from a material non-transparent for optical radiation. PRD 6 is provided with means 14 for filtration of the spectral range of maximum intensity of luminescence of the material to be concentrated, which is made in the form of a differential filter. Receiver 11 for the mineral being concentrated can be made, for example, in the form of two chambers separated with a partition for separate collection of minerals being different in type.

The sorter (FIG. 2) functions as follows. Before feeding material 2 to be separated, the synchronization unit 9 gets started and issues excitation pulses with the duration being sufficient for excitation of the luminescence SC (for example, 0.5 ms with the period of 4 ms), to X-ray sources 3 and 4 and digital processing unit 7. By means of setting device 8, the numerical values of thresholds $Usc_0$ and $Ufc_0$ and numerical values of thresholds for the separation criterion parameters are entered into unit 7 (in voltage units): K1—for PRD; K2—for $(Ufc_{irr}(t_p)/Usc_{irr}(t_{sc}))$; K3—for τ; K4—for $(Usc_{irr}(t_{sc})/Usc_{opp}(t_{sc}))$ and K5—for $(Ufc_{irr}(t_p)/Ufc_{opp}(t_p))$. Then the feed of material being separated is started. During motion over sloping chute 1, the flow of material 2 intersects the section of irradiation from source 3 and the section including section L of the free falling trajectory of material 2 at the descent from chute 1, on which it gets into the excitation/registration area where it is irradiated by periodic pulses with the duration $t_p$ of period T (FIG. 1*a, b*) from X-ray radiation source 4. Under the action of X-ray radiation sources 3 and 4, some part of minerals being in the flow of material 2 luminesces, and the volume of air getting into the irradiation areas of sources 3 and 4 luminesce also. In addition, the light reflected from the surface of non-luminescent materials of flow 2 also makes its contribution into the intensity of glow. The light signal excited by the X-ray radiation pulses of source 4 in the excitation/registration area L will be registered by PRD 5 and 6, which convert it into electrical signals coming to processing unit 7. In each period T of the sequence of exciting pulses of source 4 (FIG. 1*a, b*), unit 7 will register the light signals. If there are no luminescing minerals in the excitation/registration area L (FIG. 1*a, b*), then unit 7 will register the background light signals $Ub_{irr}$ and $Ub_{opp}$ from PRD 5 and 6, respectively, and, in case where a statistically true number of these signals is obtained, will determine the average values, respectively, for signals $Ub_{irr}$ and $Ub_{opp}$ in the excitation/registration area L (no determination of the luminescence characteristics is performed in such case), which are used for stabilisation of the zero level of PRD 5 and 6, respectively.

As a luminescing mineral appears in the excitation/registration area L, the characteristics of light signals coming from PRD 5 and 6 to processing unit 7 are changed. Unit 7 will first determine the values of $Usc_{irr}(t_{sc})$ and $Usc_{opp}(t_{sc})$ of the intensity of signals $U_{irr}(t)$ and $U_{opp}(t)$ to be registered at the moment of time $t_{sc}$ after termination of the effect of pulse $t_p$, compare the value of $Usc_{irr}(t_{sc})$ obtained to the specified threshold value of $Usc_0$ and, if $Usc_{irr}(t_{sc})>Usc_0$ (FIG. 1*a*), determine the values of characteristics of the luminescence signal U(t) specified by the separation criterion: NCF, $(Ufc_{irr}(t_p)/Usc_{irr}(t_{sc}))$, τ and $(Usc_{irr}(t_{sc})/Usc_{opp}(t_{sc}))$. Then the processing unit 7 will perform comparison of the characteristics obtained with their threshold values of K1, K2, K3 and K4 and, in case of positive result of the comparison, will issue a control signal to actuator 10. Actuator 10 will deflect the mineral to be concentrated to the corresponding chamber of receiver 11, and the remaining material will go to receiver 12 of the tailing product.

In case where unit 7, in comparing the value of $Usc_{irr}(t_{sc})$ to the specified threshold value of $Usc_0$, detects that $Usc_{irr}(t_{sc})\leq Usc_0$ (FIG. 1*b*), it will determine the luminescence signal FC value $Ufc_{opp}(t_p)$ arising during the time of $t_p$ of the effect of exciting radiation pulse of source 4 and registered by PRD 6. Unit 7 compares the value of signal $Ufc_{opp}(t_p)$ to the threshold value $Ufc_0$ specified for it (FIG. 1*b*). In case of exceedance of this value $(Ufc_{opp}(t_p)>Ufc_0)$, it will determine, as the separation parameter, the value of ratio of the luminescence signal FC value of $Ufc_{irr}(t_p)$ to be registered on the irradiated side of the flow of material 2, to the luminescence signal FC value of $Ufc_{opp}(t_p)$ to be registered on the side of the flow of material 2 being opposite to irradiation $(Ufc_{irr}(t_p)/Ufc_{opp}(t_p))$. The processing unit 7 will compare the parameter value of $Ufc_{irr}(t_p)/Ufc_{opp}(t_p)$ obtained to its threshold value of K5 and, in case of positive result of comparison, will issue a control signal to actuator 10. Actuator 10 will deflect the mineral to be concentrated to the chamber of receiver 11 designed for minerals of another type, and the remaining material will go to receiver 12 of the tailing product.

The mutual arrangement of sources 3 and 4 in the sorter ensures an increase in intensity of signals U(t) of weakly luminescing minerals in the flow of material 2 being separated not only due to an increase in the strength of X-ray radiation acting on material 2 but also due to the duration and sequence of its effect. In this process, the conditions for registration and processing of signals U(t) developed in the sorter by means of PRD 5, PRD 6 and unit 7 ensure a considerable reduction of the intensity and fluctuation of the background luminescence signal $Ub_{opp}$ during the action of X-ray radiation pulses from source 4. So the sorter provides the enhancement of sensitivity of registration of all mineral luminescence signals U(t) including minerals with a low luminescence intensity. In addition, the sequence of operations and the set of separation criterion parameters specified for processing these signals in device 7 ensure not only the selectivity of extraction of all types of minerals to be concentrated but also the possibility of their separation by types during one cycle. For example, the sorter makes it possible, in selective extraction of diamonds from the flow of material 2, to separate diamonds being present in material 2 into diamonds of type I having a sufficient intensity of luminescence signals $Usc_{irr}(t_{sc})$ and $Usc_{opp}(t_{sc})$, and diamonds of type II where SC is practically missing in the luminescence signals $U_{irr}(t)$ and $U_{opp}(t)$.

Synchronisation unit 9 and digital signal processing device 7 can be combined and made on the basis of a personal computer or microcontroller with a built-in multichannel analogue-to-digital converter. Device 8 for setting the threshold values can be made on the basis of a group of switches or a numerical keyboard connected to the microcontroller. Synchronisation unit 9 can also be made as a generator of pulses with the duration $t_p$ and period T on TTL logic IC of K155 or K555 series. PRD 5 and 6 can be made in the form of multichannel devices on the basis of photomultipliers of FEU-85 or R-6094 (Hamamatsu) type. The number of channels in PRD 5 and 6 is determined by the width of flow of material 2 being transported, which is necessary for ensuring the required production capacity of the sorter as well as specified sensitivity of PRD. Actuator 10 can be made in the form of a multichannel device on the basis of pneumatic valves of VXFA type manufactured by SMG, Japan, or mechanical damper devices. Means 14 for filtration of the spectral range of luminescence of the mineral to be concentrated in concentration of the diamond-containing material can be made in the form of light filters installed in-line and manufactured on a serial basis, for example SZS20 and ZhS10 according to GOST 9411-91. The method for X-ray-luminescent separation of minerals and the X-ray-luminescent sorter proposed in the invention meets the "industrial applicability" criterion.

Figure 2:
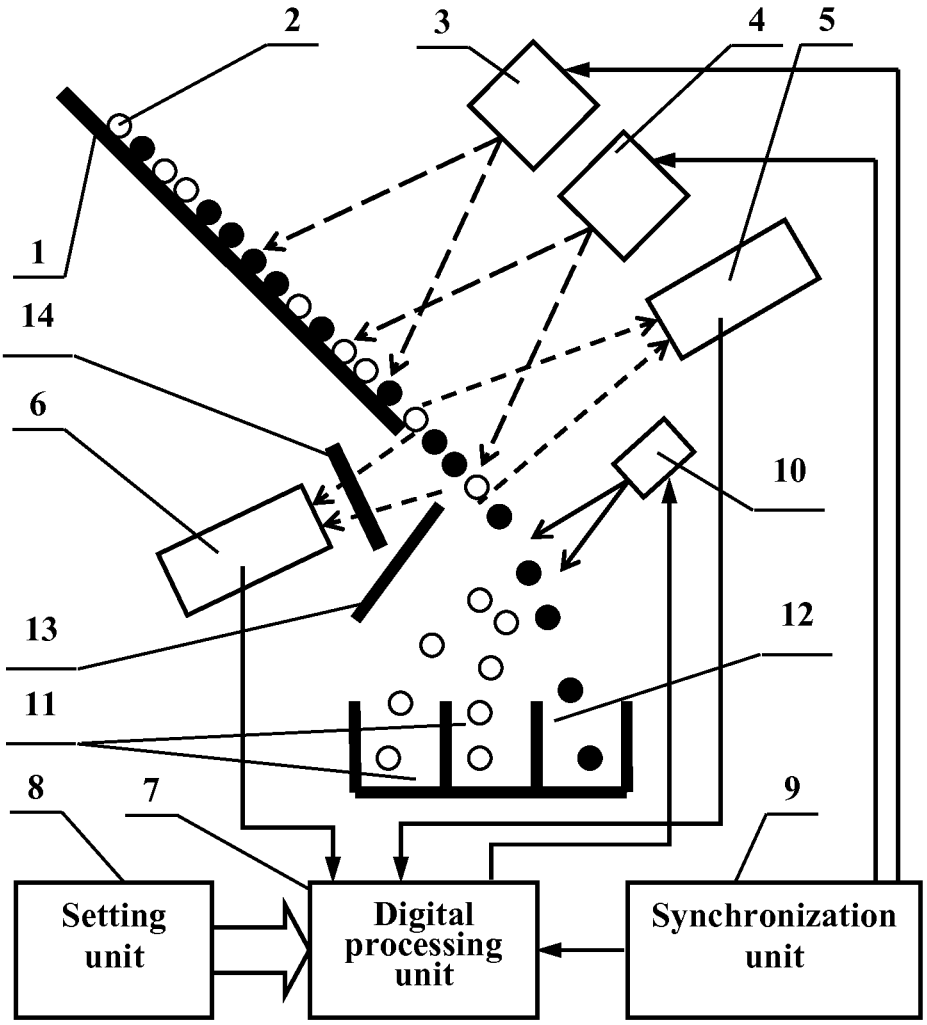
FIG. 2 shows schematically one of embodiments of the X-ray-luminescent sorter for implementation of the proposed method.
Figure 2A:
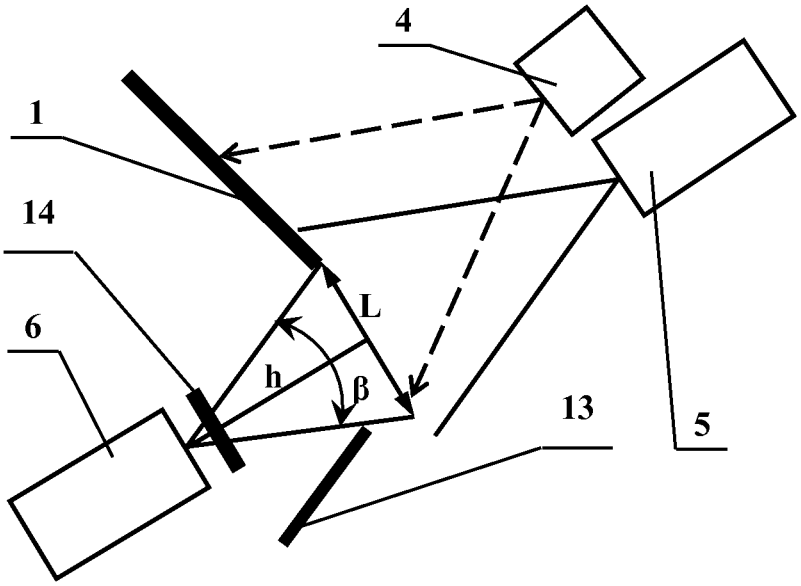
FIG. 2*a* shows schematically mutual arrangement of the sorter elements in the area of irradiation/registration in the section of free falling of the material being separated.

The X-ray-luminescent sorter version shown in FIG. 2 and made on the basis of X-ray-luminescent sorter of LS-20-09 type according to specification TU 4276-074-00227703-2007, manufactured serially by Burevestnik Science & Production Enterprise Open Joint-Stock Company, has been tested in concentration of the diamond-containing material in the conditions of the concentrating mill. During testing we managed to achieve 100% extraction of diamonds with simultaneous identification of diamonds of type I and diamonds of type II.

Thus, the proposed method for X-ray-luminescent separation of minerals and the X-ray-luminescent sorter for carrying out the method not only ensure enhancement of the selectivity of extraction of any types of minerals to be concentrated from the flow of material being separated, including minerals with low luminescence intensity, but also allow simultaneously separating them by types.

The invention claimed is:

1. A method for X-ray-luminescent separation of minerals comprising the steps of:

a) transporting a flow of a plurality of material to be separated along a path which includes a free falling trajectory;

b) irradiating the plurality of material by a first sequence of pulses of X-ray radiation within a specified section of the path and continuing irradiation of the plurality of material during transportation along the path until the plurality of material reaches a first point along the path at which a mineral luminescence signal intensity is capable of being detected and recorded;

c) registering the mineral luminescence signal intensity during a sequence period within which the plurality of material is in the free falling trajectory simultaneously on an irradiated side and on an opposite side of the plurality of material during the sequence period, the mineral luminescence signal intensity detected on the opposite side of the plurality of material being registered in an irradiated section of the plurality of material in a spectral range of a maximum luminescense of the minerals;

d) if a value of a slow component of the mineral luminescence signal intensity registered on the irradiated side of the plurality of material exceeds a first threshold value specified for it then real-time processing of the registered mineral luminescence signal intensity is performed to determine a separation criteria;

e) calculating the separation critera, wherein the separation criteria is equal to a first ratio of a first value of the slow component of the mineral luminescence signal intensity registered on the irradiated side of the plurality of material to a second value of the slow component of the mineral luminescence signal intensity registered on the opposite side of the plurality of material;

f) comparing the separation criteria with specified threshold values;

g) ejecting the minerals from the plurality of material if the result of comparison between the separation criteria and the specified threshold values meets predetermined conditions;

h) if, in step d, the slow component of the mineral luminescence signal intensity registered on the irradiated side of the plurality of material does not exceed the first threshold value specified for it, then a third value of a fast component of the mineral luminescence signal intensity registered on the opposite side of the plurality of material is compared with a second threshold value specified for it;

i) if the third value of the fast component of the mineral luminescence signal intensity registered on the opposite side of the plurality of material exceeds the second threshold value specified for it, then the separation criteria is equal to a second ratio of a fourth value of the fast component of the mineral luminescence signal intensity registered on the irradiated side of the plurality of material to the third value of fast component of the mineral luminescence signal intensity registered on the opposite side;

j) if the separation criteria obtained in step (i) exceeds the specified threshold values, the mineral is ejected from the plurality of material being separated.

2. The method according to claim 1 wherein when determining if the value of the slow component of the mineral luminescence signal intensity registered on the irradiated side of the plurality of material exceeds the first threshold value specified for it, such luminescence signal characteristics are determined as a normalized autocorrelation function, a ratio of the total intensity of the fast and slow components of the signal to the intensity of its slow component, and a luminescence decay time constant after termination of the first sequence of pulses.

3. An X-ray-luminescent sorter comprising of a transportation means for transporting a plurality of material to be separated, the transportation means having an end such that after the plurality of material passes the end the plurality of material enters a free falling trajectory, a first source of X-ray radiation located above the plurality of material being transported and capable of irradiating the plurality of material in an irradiation area being at least partially in the free falling trajectory near the end of the transportation means, a first luminescence registration photo-receiving device located on the same side as the first source of X-ray radiation with respect to the plurality of material, wherein an area of registration of luminescence of the plurality of material coinciding with the irradiation area, a unit for setting threshold values for luminescence signal intensity and threshold values for separation parameters, a synchronization unit, a sorting ejector and receiving bins for concentrated and tailing products, a digital luminescence signal processing unit configured to determine the separation criteria, comparing the separation criteria to the threshold values, and generating a command to be issued to the sorting ejector, a second source of X-ray radiation located above the plurality of material, the second source of X-ray radiation radiating the plurality of material at least immediately prior to the plurality of material reaching the end of the transportation means so as to ensure its irradiation before the plurality of material reaches the end of the transportation means, a second photo-receiving device provided with a means for spectral filtration of a range of a maximum intensity of luminescence of the plurality of material to be concentrated and located on an opposite side of the plurality of material with respect to the first luminescence registration photo-receiving device wherein a distance (h) from a centre of a receiving window of the second photo-receiving device to a middle of the irradiation area of the plurality of material in the free falling trajectory meets the following relation:

$h=L/2*tg\beta/2$ where

L is the largest linear dimension of the irradiation area of the plurality of material in the free falling trajectory;

β is the aperture of the second photo-receiving device;

and the digital luminescence signal processing unit is capable of simultaneous real-time processing of luminescence signals from the first luminescence registration photo-receiving device and the second photo-receiving device and is configured to calculate the separation criteria, a first separation criteria being a first ratio of a first value of a slow component of the luminescence signal registered on the irradiated side of the plurality of material to a second value of the slow component of the luminescence signal registered on the opposite side, a second separation criteria being a second ratio of a third value of a fast component of the luminescence signal registered on the irradiated side of the plurality of material to a fourth value of the fast component of the luminescence signal registered on the opposite side.

4. The sorter according to claim 3, wherein the second source of X-ray radiation is a pulsed X-ray radiation generator.

5. The sorter according to claim 3, wherein the second source of X-ray radiation is a constant X-ray radiation generator.

6. The sorter according to claim 3, wherein the means of spectral filtration of the second photo-receiving device is a differential optical filter.

7. The sorter according to claim 3, a field of vision of the second photo-receiving device located on the opposite side of the plurality of material is restricted to the plurality of material located in the free falling trajectory coinciding with the irradiation area, by means of structural elements of the sorter linked with the second photo-receiving device by mutual arrangement.

8. The sorter according to claim 7, the field of vision of the second photo-receiving device is restricted on one side by the end of the transportation means and on the other side by a screen being non-transparent for optical radiation and installed on the opposite side of the plurality of material with respect to the first luminescence registration photo-receiving device.

* * * * *